US005901894A

United States Patent [19]

Melocco

[11] Patent Number: 5,901,894

[45] Date of Patent: May 11, 1999

[54] HIGH PRESSURE GAS OPERATED SETTING TOOL

[75] Inventor: Michael Melocco, Mettlach, Germany

[73] Assignee: Hilti Aktiengesellschaft, Schaan, Liechtenstein

[21] Appl. No.: 08/922,979

[22] Filed: Sep. 2, 1997

[30] Foreign Application Priority Data

Sep. 2, 1996 [DE] Germany ..... 196 35 312

[51] Int. Cl.[6] ..... B25C 1/04

[52] U.S. Cl. ..... 227/10; 173/211; 227/156

[58] Field of Search ..... 227/9, 10, 11, 227/134, 156; 173/162.1, 210, 211

[56] References Cited

U.S. PATENT DOCUMENTS

| | | | |
|---|---|---|---|
| 2,893,279 | 7/1959 | Haskell et al. | 227/10 |
| 3,050,732 | 8/1962 | Termet . | |
| 3,126,630 | 3/1964 | Catlin et al. | 227/10 |
| 3,249,279 | 5/1966 | Behrend et al. | 227/10 |
| 3,301,335 | 1/1967 | Snelling | 173/162.1 |
| 3,331,546 | 7/1967 | Brunelle | 227/10 |
| 3,632,032 | 1/1972 | Termet | 227/10 |
| 3,969,989 | 7/1976 | Maurer et al. . | |
| 4,122,987 | 10/1978 | Jochum et al. | 227/10 |
| 4,134,527 | 1/1979 | Termet . | |
| 5,056,701 | 10/1991 | Bereiter | 227/10 |

FOREIGN PATENT DOCUMENTS

| | | |
|---|---|---|
| 0595160 | 5/1994 | European Pat. Off. . |
| 0732178 | 9/1996 | European Pat. Off. . |
| 1908735 | 8/1970 | Germany . |

*Primary Examiner*—Scott A. Smith
*Attorney, Agent, or Firm*—Anderson, Kill & Olick, P.C.

[57] ABSTRACT

A high-pressure gas operated setting tool including a piston guide (7), a driving piston (21) axially displaceable in the piston guide (7) and formed of a head (9) and a stem (8), and a deformable member surrounding the stem (8) and extending between a stop (17), provided in a front, in the setting direction, end portion of the piston guide (7) and a front, in the setting direction end surface of the head (9), the deformable member (11) having a substantially closed cellular structure.

9 Claims, 3 Drawing Sheets

HIGH PRESSURE GAS OPERATED SETTING TOOL

BACKGROUND OF THE INVENTION

1. Field of the Invention

The present invention relates to a high-pressure gas operated setting tool including a piston guide, a driving piston, axially displaceable in the piston guide and formed of a head and a stem, and a return element surrounding the stem and extending between a stop provided in a front, in a setting direction, end portion of the piston guide and a front, in the setting direction, end surface of the head.

2. Description of the Prior Art

German Publication DE-OS 1,939,801 discloses an explosive powder charge operated setting tool for setting nail-shaped fastening elements in a base, with the driving piston of the tool being returned to its initial position, after a setting process, by an elastic sleeve. The returning elastic sleeve surrounds the stem of the driving piston and extends between a stop, which is provided in the front, in the setting direction, end portion of the piston guide, and the front, in the setting direction, end surface of the driving piston head.

In this setting tool, the difference between the outer diameter of the return element and the inner diameter of the piston guide is large. This difference results from the fact that the return sleeve is formed of a material with high lateral expansion. This means that the reduced, in the axial direction, volume of the sleeve, is enlarged in the radial direction until the sleeve expands radially to the inner wall of the piston guide.

The largest possible axial return path of the return element and, thus, the maximum possible axial displacement of the driving piston depends on the free space between the return element and the inner wall of the piston guide.

The resiliency characteristics of the return sleeve, which is disclosed in DE-OS 1,939,801, permits a maximum reduction of the original length of the sleeve upon the sleeve compression, by half. To be able to provide for a large axial displacement of the driving piston, the increase of the empty cylindrical volume is necessary. This volume can be increased by increasing radially the guide bore of the piston guide, i.e., by increasing the free volume between the return element and the inner wall of the piston guide. A big drawback of this approach consists in that the dimensions of the setting tool are substantially increased which makes the handling of the setting tool impossible. If, e.g., a rubber is used for manufacturing the sleeve, then the relatively long sleeve has an increased own weight. The large weight of the sleeve negatively affects the entire weight of the setting tool and increases the nose-heaviness of the setting tool.

Accordingly, the object of the invention is a high pressure gas operated setting tool that can be economically produced, has a reliable, long-lasting piston guide for the driving piston, has small dimensions, and is easy to handle.

SUMMARY OF THE INVENTION

These and other objects of the present invention, which will become apparent hereinafter, are achieved by forming the return element as a deformable member having a substantially close cellular or porous structure. The return element, which is formed according to the present invention, because of its structure, can be compressed up to 20% of its original length, i.e., a compression path of 80% of the original length of the return sleeve is achieved. This permits to produce setting tools with small dimensions. The pressure first causes the reduction of volume of separate cells of the substantially closed cellular structure and then the compression of the entire sleeve. The maximum compression depends on the volume weight of the deformable tubular member. E.g., the volume weight of the return element can be in a range of 350 kg/m3 to 600 kg/m3, and the volume of all cells or pores can be within 50–63% range.

Based on rigidity, manufacturing and recycling considerations, the deformable member is preferably formed of elastic polyurethane.

The manufacturing of the cellular or porous structure of the deformable member according to the present invention can be made, e.g., by a foaming process. Separate cells or pores of the cellular structure have a diameter maximum of 0.5 mm.

The deformable member according to the present invention can be produced, e.g., from polyurethane sold under a name of CELLASTO™ which is produced by a firm Elastogran GmbH of D-2844, Lemforde, Germany.

to provide for controlled deformation during the axial compression, the deformable member has at least one circumferential groove. The provision of the circumferential groove permits to reduce the cross-section of the deformable member and, thus, the axial rigidity of the deformable member in the groove region. This results in that the deformable member is first compressed in the region of the groove.

The deformable member can have a plurality of circumferential grooves which are either provided along the entire length of the deformable member or at least in one of the end regions of the deformable member or in its middle. The distance between separate grooves and their depth as well as their location along the deformable member can be uniform or variable.

From the manufacturing point of view, the grooves advantageously are formed in planes, which extend transverse to the longitudinal axis of the deformable member, and have, preferably, a V-shaped cross-section.

The end surfaces of the deformable member are subjected to high mechanical loads, and the side of the deformable member adjacent to the driving piston, is also subjected to high temperatures. To insure protection of the deformable member, a protection washer can be provided at least at one end surface of the deformable member. The protection of the deformable member with a protection washer is only then possible when the protection washer is axially aligned with the deformable member. In order to be able to achieve the necessary axial alignment of the deformable member and the protection washer, the diameter of which matches that of the deformable member, the deformable member and the protection washer are form-lockingly connected with each other.

It is also possible, e.g., to co-axially align the deformable member with the piston guide by providing protection washers at each end surface of the deformable member, with the outer diameter of the protection washers corresponding to the inner diameter of the piston guide.

In this case also a form-locking connection of the deformable member with the protection washer is necessary.

Based on wear considerations and to provide good damping characteristics, the protection washers are advantageously formed of a rubber material.

In order to provide for friction-free axial compression of the deformable member according to the present invention, the outer diameter of the deformable member is made smaller than the inner diameter of the piston guide. The outer diameter of the deformable member at the initial length of the deformable member, before compression, preferably corresponds from about 0.65 to about 0.98 of the inner diameter of the guide piston.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENT

Figure 1:
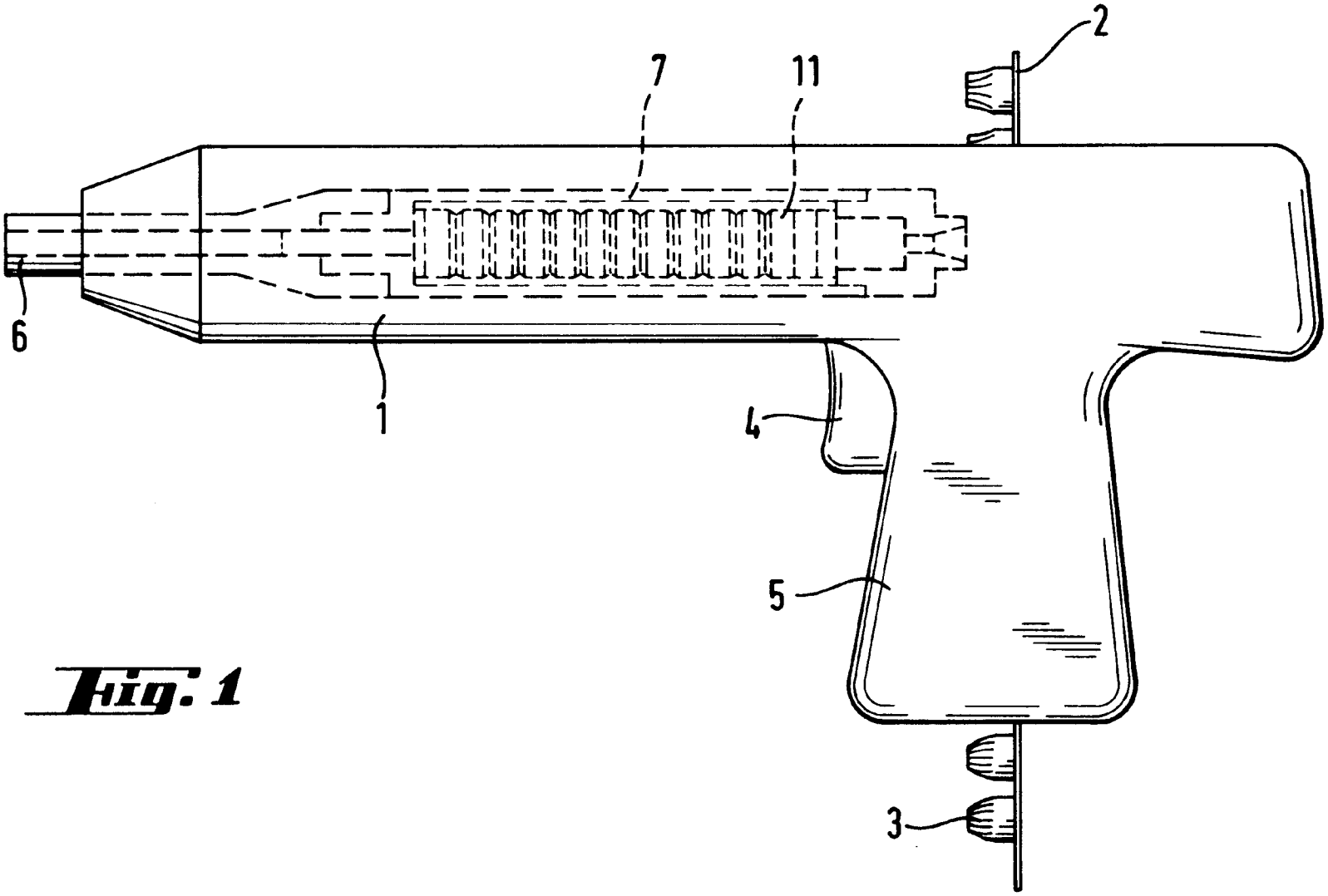
FIG. 1 shows a simplified side elevational view of a setting tool according to the present invention.

A setting tool according to the present invention, which is shown in FIG. 1, includes a housing 1, a handle 5 formed integrally with the housing 1, and a strip-shaped magazine 2 for explosive powder cartridges 3 which extends through the handle 5. The firing switch 4 serves for activating an ignition mechanism, not shown. A stud guide 6, which projects beyond the end region of the housing 1 in a setting direction, is displaceable, together with the piston guide 7 which adjoins the stud guide 6, axially relative to the housing into a tool application or pre-setting position which is not shown.

Figure 2:
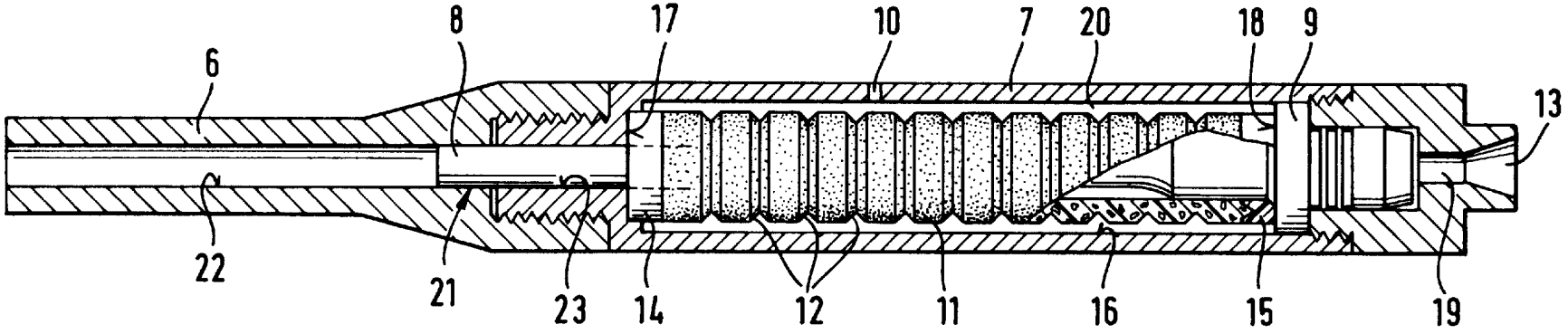
FIG. 2 shows a cross-sectional view of a piston guide, together with a driving piston in its initial position, of the setting tool shown in FIG. 1.

The piston guide 7, which is shown in FIGS. 1–2, has a central, cylindrical guide bore 20 which extends parallel to the longitudinal extent of the piston guide 7. A cartridge chamber 13 is provided in the end region of the piston guide 7 opposite to the setting direction. A connection channel 19 connects the cartridge chamber 13 with the guide bore 20.

A piston 21 for driving a fastening element, not shown, into a base, likewise not shown, has a head 9 and a stem 8. The outer diameter of the head 9, which substantially corresponds to the inner diameter of the guide bore 20, is larger than the diameter of the stem 8. The guide bore 20 guides the head 9 during the axial displacement of the driving piston 21. In its end region facing in the setting direction, the guide bore 20 has a stop 17 in the form of a circular surface and which serves as a support for the head 9 of the driving piston 21, with the head 9 being supported against the stop 17 via a return element formed as a deformable member 11 inserted between the stop 17 and the head 9. The outer wall of the piston guide 7 has, in the region of the stop 17, a vent opening 10 for venting the front, in the setting direction, portion of the guide bore 20 when the driving piston 21 is displaced, during the setting process, in the setting direction.

The stem 8 of the driving piston 21 is displaceable in a central bore 23 of the piston guide 7. The bore 23 is coaxial with the guide bore 20 of the piston guide 7 and a central bore 22 of the stud guide 6. The diameter of the bore 22 corresponds substantially to the diameter of the bore 23 of the piston guide 7.

The central bore 23 extends substantially along a portion of the piston guide 7 having a reduced diameter, which portion is surrounded by an enlarged portion of the stud guide 6.

The deformable member 11, which is provided between the head 9 and the stop 17, surrounds the stem 8 and is form-lockingly connected with two protection washers 14–15 provided on the opposite end surfaces of the deformable member 11.

In FIG. 2, the driving piston 21 is in its initial position. The expanded length of the deformable member 11 corresponds substantially to the distance between the stop 17 and the front, in the setting direction, end surface 18 of the head 9 minus the width of the two washers 14 and 15. The deformable member 11 has a plurality of spaced circular grooves 12. The distance between separate grooves can be, e.g., from 8 mm to 20 mm. The cross-section of the grooves 12 taken transverse to the longitudinal extent of the deformable member 11 is substantially V-shaped. The deformable member 11 and both washers 14, 15 have a smaller outer diameter than an inner diameter of the guide bore 20.

Figure 3:
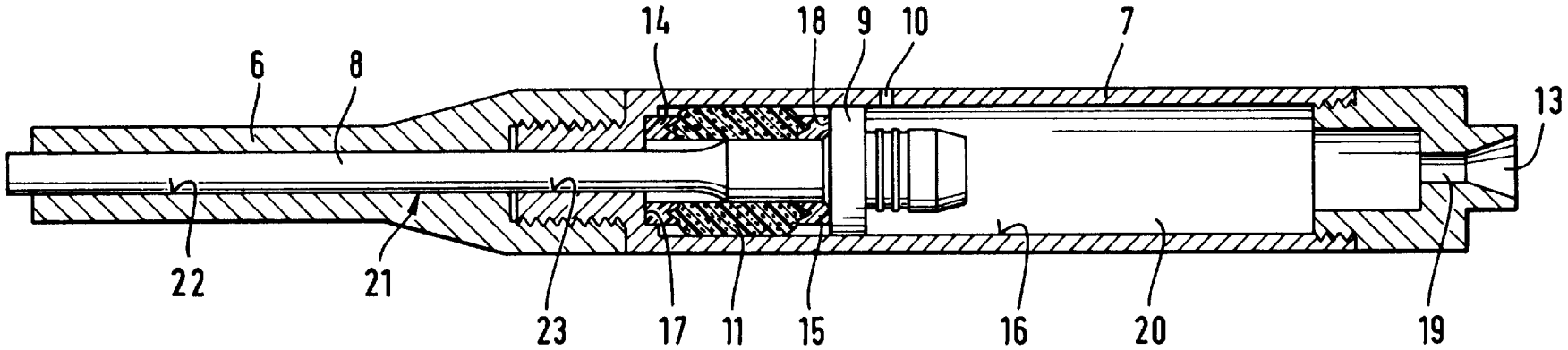
FIG. 3 shows a cross-sectional view of a piston guide, together with the driving piston in its operational position, of the setting tool shown in FIG. 1.

FIG. 3 shows piston 21 in its operational or setting position. In this position, the stem 8 of the driving piston 21 projects beyond the front, in the setting direction, end surface of the stud guide 6. The molded member 20 is compressed to 20% of its original length.

With the deformable member 11 being formed with a substantially cellular or porous structure, the cells are compressed first, and the deformable member is deformed radially so that the outer diameter of the compressed member 11 becomes substantially equal to the inner diameter of the guide bore 20 of the piston guide 7.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A high-pressure gas operated setting tool, comprising of a piston guide (7); a driving piston (21) axially displaceable in the piston guide (7) and formed of a head (9) and a stem (8); and a return element surrounding the stem (8) and extending between a stop (17), provided in a front, in a setting direction, end portion of the piston guide (7) and a front, in a setting direction, end surface of the head (9), the return element being formed as a deformable member (11) having a substantially closed cellular structure, wherein the deformable member (11) has a length capable of being reduced in an operational position of the driving piston (21), to 20% of an initial length of the deformable member (11).

2. A setting tool as set forth in claim 1, wherein the deformable member (11) is formed of elastic polyurethane.

3. A setting tool as set forth in claim 1, wherein separate cells of the cellular structure of the deformable member (11) have a diameter maximum 0.5 mm.

4. A setting tool as set forth in claim 1, wherein the deformable member (11) has at least one circumferential groove (12).

5. A setting tool as set forth in claim 4, wherein the at least one circumferential groove (12) lies in a plane extending transverse to a longitudinal axis of the deformable member (11) and has a V-shaped cross-section taken in the plane extending transverse to the longitudinal axis of the deformable member.

6. A setting tool as set forth in claim 1, wherein the deformable member (11) has a protection washer at least at one of opposite end faces thereof.

7. A setting tool as set forth in claim 6, wherein the deformable member (11) and the protection washer (14–15) form-lockingly engage each other.

8. A setting tool as set forth in claim 6, wherein the protection washer is formed of a rubber material.

9. A setting tool as set forth in claim 1, wherein the deformable member (11) has, in an initial, non-operating position of the driving piston (21), a length substantially corresponding a distance between the stop (17) and the end face (18) of the driving piston (21), and an outer diameter equal to about 0.65 to about 0.98 of an inner diameter of the piston guide (7).

* * * * *